US010814946B2

(12) United States Patent
Ranieri

(10) Patent No.: US 10,814,946 B2
(45) Date of Patent: Oct. 27, 2020

(54) WATER RESCUE SYSTEM

(71) Applicant: MOTONAUTICA F.LLI RANIERI SRL, Soverato (IT)

(72) Inventor: Salvatore Ranieri, Soverato (IT)

(73) Assignee: MOTONAUTICA F.LLI RANIERI SRL, Soverato (CZ) (IT)

( * ) Notice: Subject to any disclaimer, the term of this patent is extended or adjusted under 35 U.S.C. 154(b) by 41 days.

(21) Appl. No.: 16/308,967

(22) PCT Filed: Jun. 13, 2016

(86) PCT No.: PCT/IB2016/053478
§ 371 (c)(1),
(2) Date: Dec. 11, 2018

(87) PCT Pub. No.: WO2017/216600
PCT Pub. Date: Dec. 21, 2017

(65) Prior Publication Data
US 2019/0308703 A1 Oct. 10, 2019

(51) Int. Cl.

| | |
|---|---|
| ***B63C 9/22*** | (2006.01) |
| ***B63B 7/08*** | (2020.01) |
| ***B63C 9/04*** | (2006.01) |
| ***B63C 9/02*** | (2006.01) |
| *B63C 9/26* | (2006.01) |

(52) U.S. Cl.
CPC ..... *B63C 9/22* (2013.01); *B63B 7/08* (2013.01); *B63C 9/02* (2013.01); *B63C 9/04* (2013.01); *B63B 7/085* (2013.01); *B63C 2009/042* (2013.01); *B63C 2009/265* (2013.01)

(58) Field of Classification Search
CPC ..... B63B 7/08; B63C 9/22; B63C 9/02
See application file for complete search history.

(56) References Cited

U.S. PATENT DOCUMENTS

| | | | | |
|---|---|---|---|---|
| 5,342,230 | A * | 8/1994 | Louis | B63C 9/22 441/42 |
| 5,630,740 | A * | 5/1997 | Lavorata | B63C 9/24 441/42 |
| 6,106,348 | A * | 8/2000 | Loisel | B63C 9/155 441/108 |
| 6,739,278 | B2 * | 5/2004 | Callahan | B63B 7/082 114/345 |
| 7,708,611 | B2 * | 5/2010 | Simon-Bouhet | B63C 9/02 441/41 |

(Continued)

FOREIGN PATENT DOCUMENTS

| | | | |
|---|---|---|---|
| CN | 2806305 Y | 8/2006 | |
| EP | 1953080 A1 * | 8/2008 | B63C 9/02 |

(Continued)

OTHER PUBLICATIONS

International Search Report and Written Opinion issued in PCT/IB2016/053478, dated Jan. 9, 2017; ISA/EP.

*Primary Examiner* — S. Joseph Morano
*Assistant Examiner* — Jovon E Hayes
(74) *Attorney, Agent, or Firm* — Harness, Dickey & Pierce, P.L.C.

(57) ABSTRACT

A water rescue system comprising at least a tubular element connectable to crafts, wherein the tubular element comprises a housing for an inflatable boat.

16 Claims, 7 Drawing Sheets

(56) References Cited

U.S. PATENT DOCUMENTS

| | | | | |
|---|---|---|---|---|
| 8,127,388 | B2 * | 3/2012 | Watchorn | B63B 27/143<br>14/2.6 |
| 9,272,757 | B2 * | 3/2016 | Ibsen | B63B 23/48 |
| 2008/0188148 | A1 * | 8/2008 | Simon-Bouhet | B63C 9/04<br>441/41 |
| 2013/0333608 | A1 * | 12/2013 | Bertsch | B63C 9/03<br>114/350 |
| 2019/0308703 | A1 * | 10/2019 | Ranieri | B63B 7/08 |

FOREIGN PATENT DOCUMENTS

| | | | | |
|---|---|---|---|---|
| EP | 2110308 | A1 * | 10/2009 | B63C 9/22 |
| WO | WO-9203333 | A1 * | 3/1992 | B63C 9/22 |

* cited by examiner

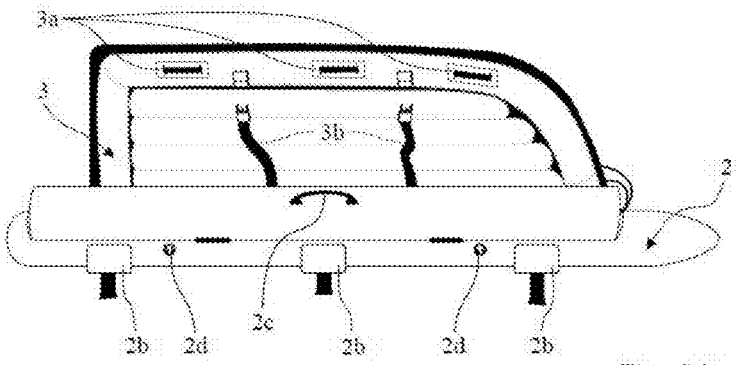
Fig. 2A
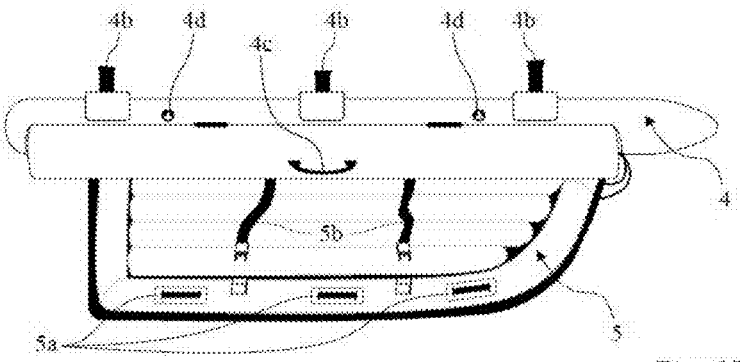
Fig. 2B
Fig.2

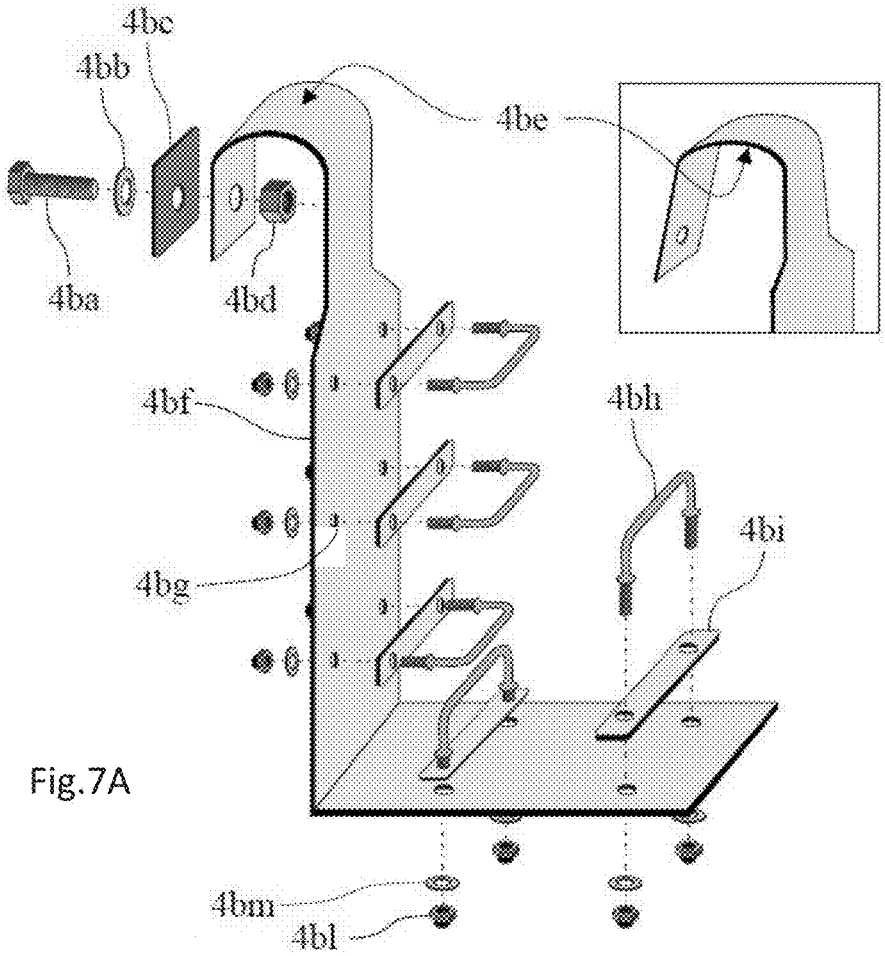
Fig.7A
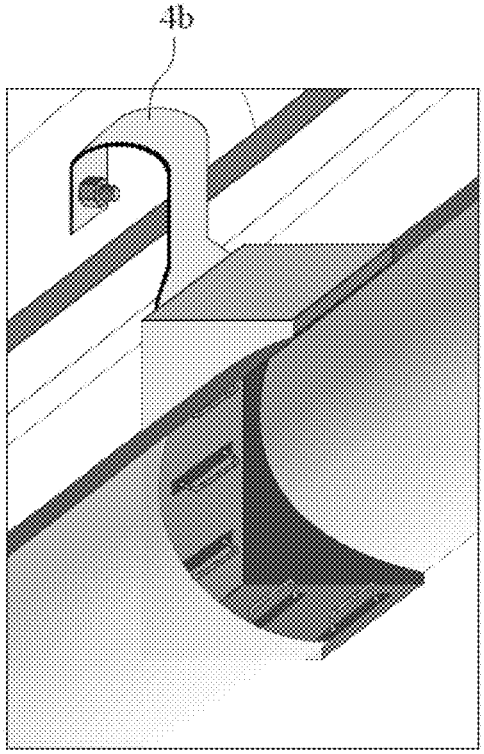
Fig.7B
Fig.7

WATER RESCUE SYSTEM

CROSS-REFERENCE TO RELATED APPLICATIONS

This application is a U.S. National Phase Application under 35 U.S.C. 371 of International Application No. PCT/IB2016/053478, filed on Jun. 13, 2016, and published in English as WO 2017/216600 A1 on Dec. 21, 2017. The entire disclosures of the above applications are incorporated herein by reference.

FIELD

The present invention relates to a water rescue system.

BACKGROUND

This section provides background information related to the present disclosure, which is not necessarily prior art.

More in particular, the present invention relates to a water rescue system of the type applicable to a ship, or boat or watercraft used during rescue operation.

As is known, different types of water rescue systems exist. As an example, one of these systems is described in the utility model CN2806305 which provides a self-inflatable life boat. The boat comprises a rubber boat body which is used as an air bag, a strake which is arranged on the bottom of the rubber boat body and an air outlet valve which is arranged on the rubber boat body. An air producing device is provided with the rubber boat body. The self-inflatable life boat can be folded and stored in normal times, so the space of a boat is greatly saved and the boat can be prepared with more life boats. The boat can automatically and quickly be inflated in emergency situation, so crew and passengers on the boat have enough time to escape.

Rescue boards able to be mounted on a watercraft back are well known. The rescue board is rigid and can have some cross webbing to secure the rescued person on it. Anyway rescue boards have to be placed in the back portion of the watercraft so as the rescued person is subject to bumps and splashes due to the water motion.

Although functional in several aspects, the solutions of the above type can be applied in a wide range of boats or watercrafts but determining a boat interior space reduction. In addition, the known solutions do not include a first aid kit in their structure.

A first known solution presented in the patent WO9203333 is connected to an inflatable life-saving device of the inflatable life raft type. A raft (1) packed in a container (2) comprises a first sealed compartment (4) and a second sealed compartment (5), which sealed compartments are separated by a bulkhead (6) and are delimited respectively by an upper cover (7) and a lower cover (8) which are fixed on said bulkhead. The first sealed compartment receives the inflatable raft and the second sealed compartment comprises the survival equipment. The technical field of the invention is that of the construction of life raft.

A second solution presented in the patent application EP2110308, in which the container (1) has complementary semi-shells (3, 4) whose opposite edges comprising complementary support bearings (7, 8) equipped with O-ring joints. The semi-shells are made of composite material. The support bearings are fixed with respect to each other under the effect of depression created in the container. A triggering unit (10) triggers the opening of the container by suppressing the depression inside the container.

A third solution described in the patent EP1953080 is related to a device (1) having a container (2) including rigid shells (3, 4) and an inner partition (7) that subdivides the container into compartments (C, Ca). The container contains deflated and folded lifesaving rafts (5, 6) arranged in the respective compartments, where the raft (5) is a loading platform. An automatic triggering type deflation unit is associated with the raft (5) in a manner that the raft (5) is deflated when the device is operated. The raft (6) is associated with manual/automatic actuating type deflatable triggering units that trigger their deflation after deflation of the raft (5).

Furthermore, the water rescue systems already known are not securely fixed to a boat or watercraft.

SUMMARY

This section provides a general summary of the disclosure, and is not a comprehensive disclosure of its full scope or all of its features.

The present disclosure includes a water rescue system which is safe, well equipped and aerodynamic, usable for more than one rescue and that can be applied and securely fixed to a wide range of boats and watercrafts without reducing the space available to the rescuer or the driver inside the boat, such as to overcome the limits of the known water rescue system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

For a better understanding of the present invention a preferred embodiment is now described, purely as non-limiting example, with reference to the accompanying drawings, in which:

FIGS. 2A-2B show schematic two-dimensional top views of inflatable boats comprised in the water rescue system, according to the invention;

FIGS. 7A-7B show schematic three-dimensional views of connection means of inflatable boats comprised in the water rescue system, according to the invention;

DETAILED DESCRIPTION

Example embodiments will now be described more fully with reference to the accompanying drawings.

Figure 1:
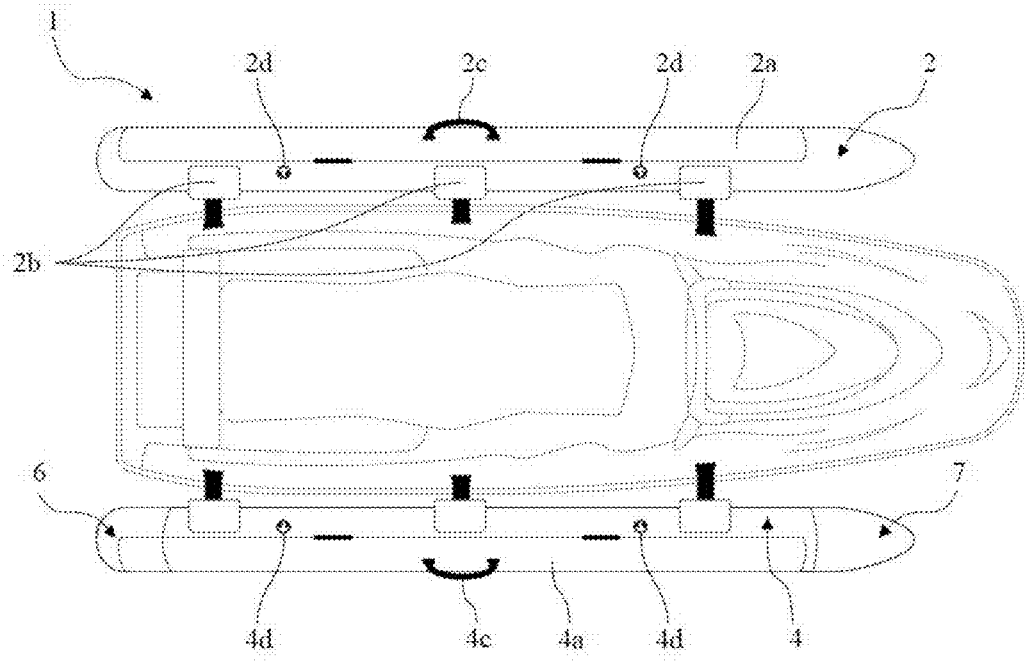
FIG. 1 shows a schematic top view of a water rescue system applied to a watercraft, according to the invention.

With reference to these figures, a water rescue system is shown, according to the invention. In particular, FIGS. 1 and 2 show a water rescue system 1 comprising at least a tubular element comprising a housing for a first inflatable boat. More in details, according to a first embodiment of the invention, the water rescue system 1 comprises: a first tubular element 2 comprising a housing 2*a* for a first inflatable boat 3, shown in FIG. 2, and a second tubular element 4 comprising a housing 4*a* for a second inflatable boat 5.

Advantageously according to the invention, the tubular elements 2 and 4 are made of fiberglass or plastic materials.

According to an aspect of the invention, each tubular element 2 and 4 comprises at one end a housing 6 for a first aid kit and at the opposite end a housing 7 for an automatic inflation device configured to be used to inflate the inflatable boats 3 and 5.

According to an aspect of the invention, the housing 7 for an automatic inflation device is provided with a valve which is opened when the automatic inflation device has to be used to inflate the boats 3 and 5.

Moreover, according to an aspect of the invention, each tubular element 2 and 4 is provided with connection means 2*b* and 4*b* to a ship, or boat, or watercraft used during rescue operation. Just as an example, the figures show the system 1 applied to a watercraft 20.

According to another aspect of the invention, each tubular element 2 and 4 is provided with a handle 2*c* and 4*c* for making easy the pulling of the inflatable boats 3 and 5 from the housings 2*a* and 4*a*.

According to another aspect of the invention, each tubular element 2 and 4 is provided with safety locks 2*d* and 4*d*.

According to another aspect of the invention, each inflatable boat 3 and 5 is provided with safety valve, not shown in the figures.

According to another aspect of the invention, each inflatable boat 3 and 5 is provided with handling means 3*a* and 5*a* to be used by rescued people transported on the inflatable boats 3 and 5.

According to another aspect of the invention, each inflatable boat 3 and 5 is provided with belts 3*b* and 5*b* for retaining rescued people transported on the inflatable boats 3 and 5.

Figure 3:
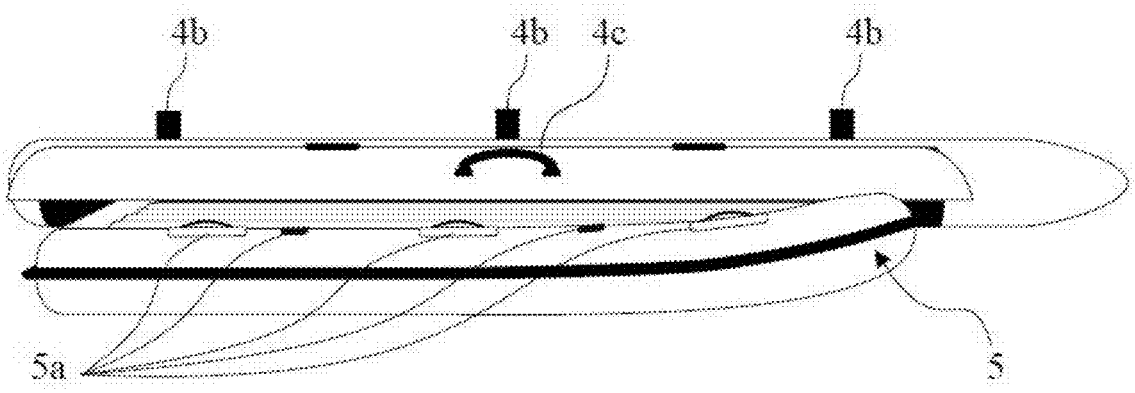
FIG. 3 shows a schematic three-dimensional view of one of the inflatable boats of FIG. 2, according to the invention.

According to another aspect of the invention, the front portion of each inflatable boat 3 and 5 is raised with respect to the water level, as shown in FIG. 3.

Figure 4:
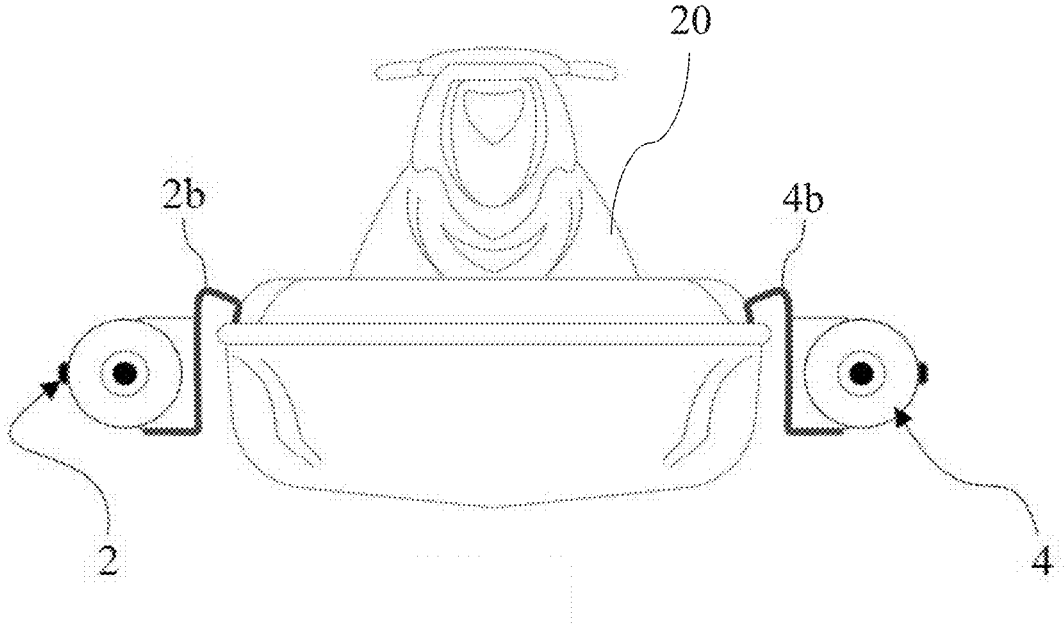
FIG. 4 shows a schematic two-dimensional back view of the watercraft comprising the water rescue system, according to the invention.

The FIG. 4 shows a back view of the system 1 applied to the watercraft 20.

Figure 5:
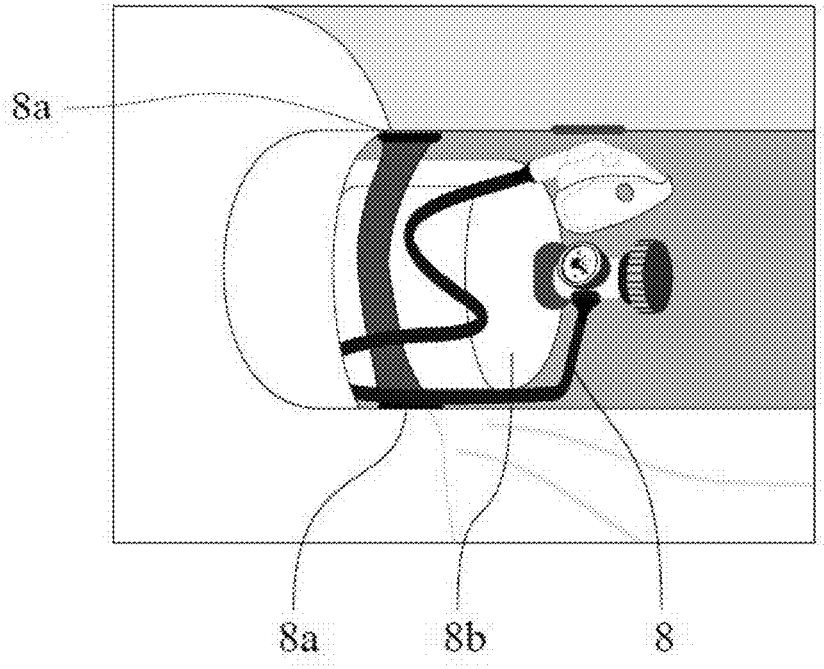
FIG. 5 shows a schematic section view of a housing for an aid kit comprised in the water rescue system, according to the invention.

According to an aspect of the invention, as shown in FIG. 5, the housing 6 for a first aid kit comprises a unit 8 comprising an oxygen cylinder 8*b* and a mask provided with fixing seals 8*a*.

Figure 6:
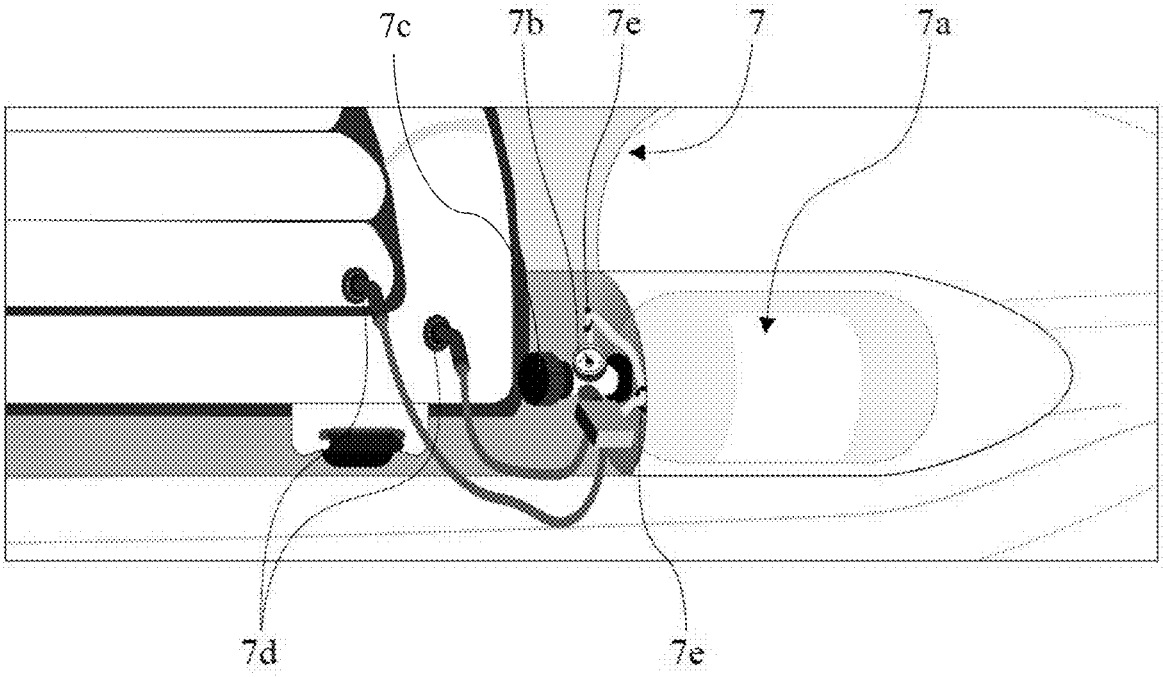
FIG. 6 shows a schematic section view of a housing for an automatic inflation device comprised in the water rescue system, according to the invention.

According to another aspect of the invention, as shown in FIG. 6, the housing 7 for an automatic inflation device comprises an air cylinder 7*a* for the inflation of the inflatable boats 3 and 5; an air level indicator 7*b* inside the cylinder 7*a*; a tap 7*c* for opening/closing the inflatable boats 3 and 5; elbow coupling 7*d* configured for inserting the air inside the inflatable boats 3 and 5; sealing and fixing system 7*e* for the air cylinder 7*a*.

FIG. 7 shows, in more details, the connection means 4*b*, which is identical to 2*b*. In particular, the connection means 4*b* is connected to the boat, for example the watercraft 20, by means of a bolt 4*ba*, a washer 4*bb*, a reinforcement plate 4*bc* and a clamping nut 4*bd*.

Advantageously according to the invention, the connection means 4*b* comprises a first curved portion 4*be* having a radius curvature which is variable depending on the type of boat it has to be fixed.

Advantageously according to the invention, the connection means 4*b* comprises a L-shaped second portion 4*bf* provided with holes 4*bg* for connection to the boat by means of connection means 4*bh* to be inserted in reinforcement plates 4*bi* and to be blocked by a nut 4*bl* and a washer 4*bm*.

Advantageously, according to the invention, the connection means 4*b* allow the water rescue system to be easily installed into and removed from a wide range of boats, watercrafts or ships.

More in detail, as shown in the FIG. 7B, according to an aspect of the invention, each tubular element 2 and 4 is provided with a portion, for example the flat portion 4*e* shown in the figure, shaped so that it can be fixed to the L-shaped second portion 4*bf*, which is made of steel or aluminum alloy.

Advantageously according to the invention, the connection means 4*b* is made of steel.

The same elements of the connection means 4*b* are comprised in the connection means 2*b* which is not described for the sake of brevity.

Figure 8:
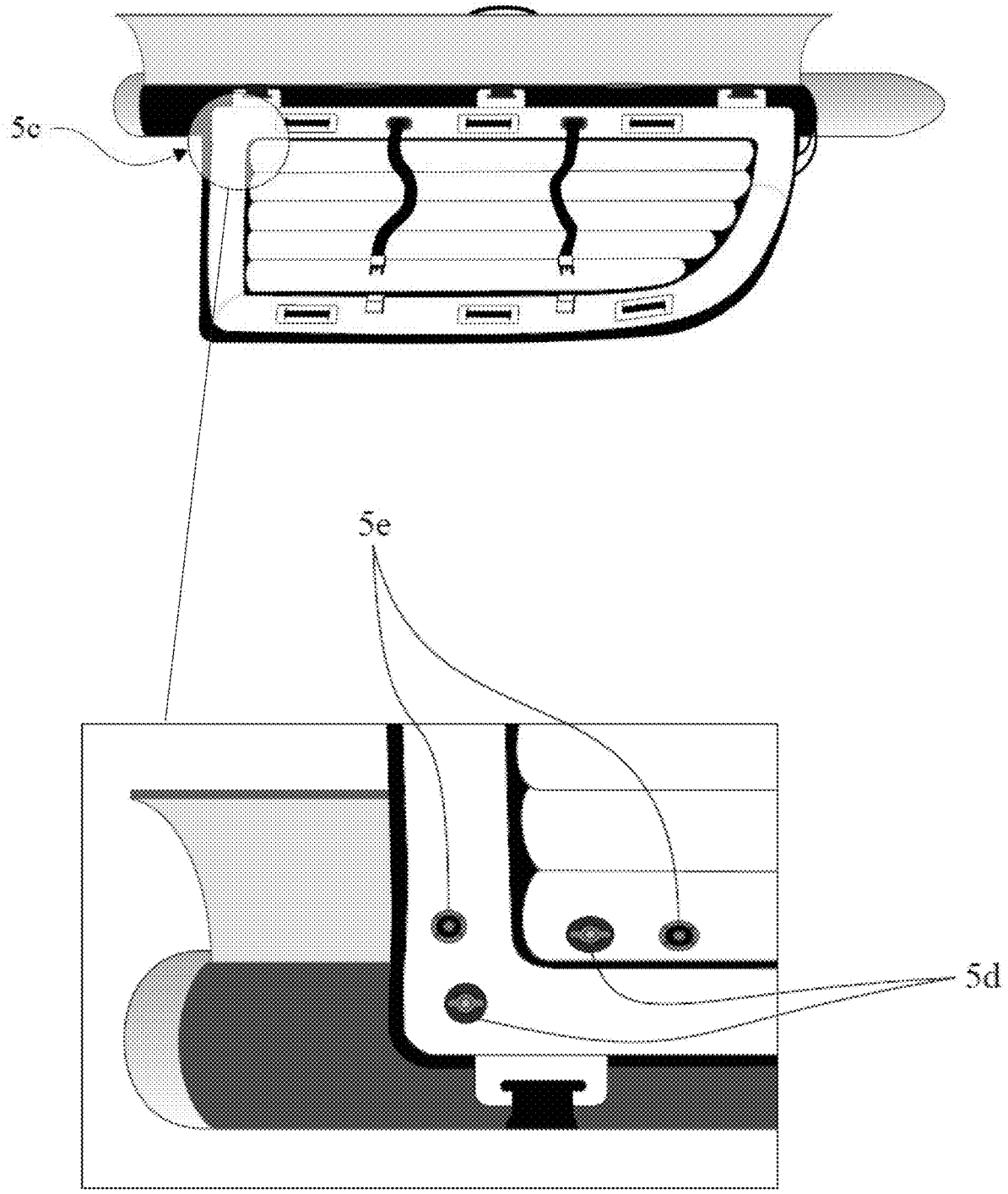
FIG. 8 shows a schematic two-dimensional view of the inflatable boat and a zoomed view of its inferior portion, according to the invention.

The FIG. 8 shows a more detailed view of the inferior portion 5*c* of the inflatable boat 5 comprising deflation valves 5*d* and overflow vent valves 5*e*.

Figure 9:
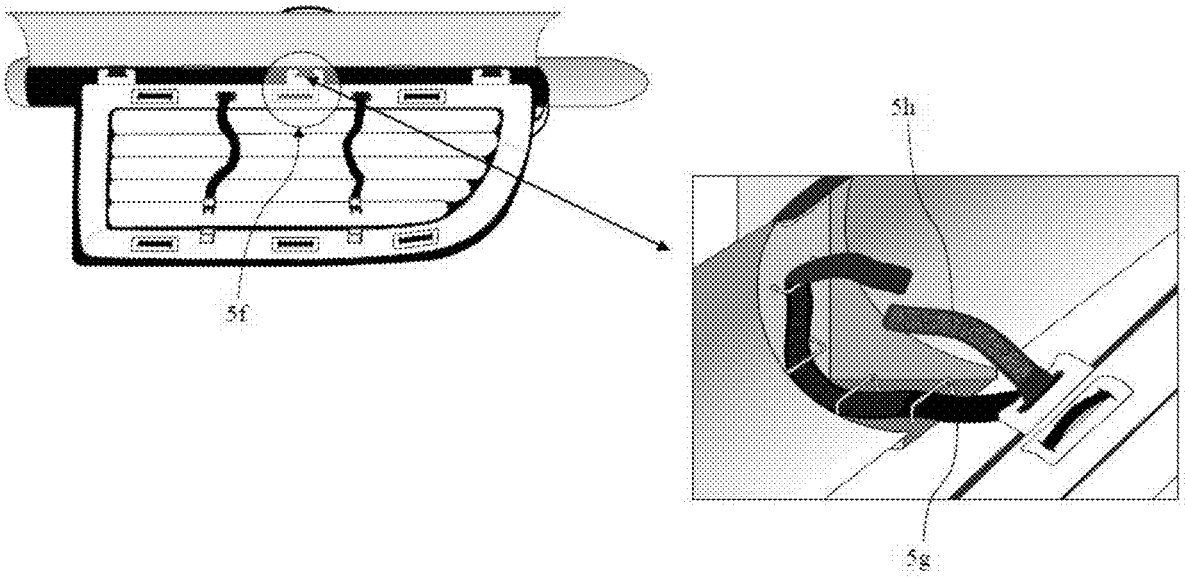
FIG. 9 shows a schematic two-dimensional view of the inflatable boat and a zoomed view of an interior section of its portion corresponding to the connection means of FIGS. 7A-7B, according to the invention.

The FIG. 9 shows a more detailed view of the interior section of a portion 5*f* of the inflatable boat 5 corresponding to the connection means 4*b*. This portion 5*f* comprises a fastener belt 5*g* and a velcro strap 5*h* for the fastening of the belt 5*g*.

Therefore, the water rescue system according to the invention is compact.

Another advantage of the water rescue system according to the invention is that it is easy to use.

A further advantage of the water rescue system according to the invention is that can be used with different type of boats.

Finally, the water rescue system according to the invention is low cost.

Finally, it is clear that the water rescue system described and illustrated here can be modified and varied without departing from the protective scope of the present invention, as defined in the appended claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A water rescue system comprising at least a tubular element connectable to crafts comprising a housing for an inflatable boat, wherein each tubular element is provided with connection means for the connection to the craft used during rescue operation comprising a bolt, a washer, a reinforcement plate and a clamping nut;

wherein the at least a tubular element comprises at one end a housing for a first aid kit and at an opposite end a housing for an automatic inflation device configured to be used to inflate the inflatable boat.

2. The water rescue system according to claim 1, wherein the housing comprises a unit comprising an oxygen cylinder and a mask provided with fixing seals.

3. The water rescue system according to claim 1, wherein the housing is provided with a valve configured to be opened when the automatic inflation device has to be used to inflate the boat.

4. The water rescue system according to claim 1, wherein the housing comprises an air cylinder for the inflation of the boat, an air level indicator inside the cylinder, a tap for opening/closing the inflatable boat, elbow coupling configured for inserting the air inside the inflatable boat and sealing and fixing system for the air cylinder.

5. The water rescue system according to claim 1, wherein the connection means comprises a first curved portion having a radius curvature which is variable depending on the type of boat it has to be fixed and a L-shaped second portion provided with holes for connection to the craft by means of connection means to be inserted in reinforcement plates and to be blocked by a nut and a washer.

6. The water rescue system according to claim 1, wherein each tubular element is provided with a handle for pulling of the inflatable boats from the housings.

7. The water rescue system according to claim 1, wherein each tubular element is provided with safety locks.

8. The water rescue system according to claim 1, wherein each inflatable boat is provided with a safety valve.

9. The water rescue system according to claim 1, wherein each inflatable boat is provided with handling means to be used by rescued people transported on the inflatable boats.

10. The water rescue system according to claim 1, wherein each inflatable boat is provided with belts for retaining rescued people transported on the inflatable boats.

11. The water rescue system according to claim 1, wherein the front portion of each inflatable boat is raised with respect to the water level.

12. The water rescue system according to claim 1, wherein at least a tubular element is made of a metal alloy.

13. The water rescue system according to claim 1, wherein the inflatable boat comprises an inferior portion comprising deflation valves and overflow vent valves and a portion corresponding to the connection means comprising a fastener belt and a velcro strap for the fastening of the belt.

14. The water rescue system according to claim 1, wherein the craft is a watercraft or a boat or a ship.

15. A water rescue system comprising at least a tubular element connectable to crafts comprising a housing for an inflatable boat, wherein each tubular element is provided with connection means for the connection to the craft used during rescue operation comprising a bolt, a washer, a reinforcement plate and a clamping nut;

wherein the connection means comprises a first curved portion having a radius of curvature which is variable depending on the type of boat it has to be fixed and a L-shaped second portion provided with holes for connection to the craft by means of connection means to be inserted in reinforcement plates and to be blocked by a nut and a washer.

16. A water rescue system comprising at least a tubular element connectable to crafts comprising a housing for an inflatable boat, wherein each tubular element is provided with connection means for the connection to the craft used during rescue operation comprising a bolt, a washer, a reinforcement plate and a clamping nut;

wherein each tubular element is provided with safety locks.

* * * * *